US006663234B2

(12) United States Patent
Roof et al.

(10) Patent No.: US 6,663,234 B2
(45) Date of Patent: Dec. 16, 2003

(54) INK CARTRIDGE PROVIDING IMPROVED INK SUPPLY

(75) Inventors: Bryan J. Roof, Fairport, NY (US); Dennis M. Lengyel, Hemlock, NY (US); Edward M. Carrese, Rochester, NY (US); David P. Breemes, Sr., Palmyra, NY (US); Louis F. Lavallee, Webster, NY (US); Sara Reynolds, Farmington, NY (US); Hiep H. Nguyen, Rochester, NY (US); Eric A. Merz, Palmyra, NY (US); Christopher S. Mullin, Amherst, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/100,251

(22) Filed: Mar. 15, 2002

(65) Prior Publication Data

US 2002/0186286 A1 Dec. 12, 2002

Related U.S. Application Data

(60) Provisional application No. 60/297,365, filed on Jun. 11, 2001.

(51) Int. Cl.[7] ..... B41J 2/175

(52) U.S. Cl. ..... 347/86

(58) Field of Search ..... 347/7, 86, 85, 347/87, 89

(56) References Cited

U.S. PATENT DOCUMENTS

| | | | | | |
|---|---|---|---|---|---|
| 5,289,212 | A | | 2/1994 | Carlotta | 347/87 |
| 5,453,771 | A | | 9/1995 | Waseda et al. | 347/86 |
| 5,623,291 | A | * | 4/1997 | Morandotti et al. | 347/7 |
| 5,790,158 | A | * | 8/1998 | Shinada et al. | 347/86 |
| 5,815,184 | A | * | 9/1998 | Ujita et al. | 347/89 |
| 5,997,121 | A | | 12/1999 | Altfather et al. | 347/7 |
| 6,095,642 | A | * | 8/2000 | Koitabashi et al. | 347/86 |
| 6,137,512 | A | * | 10/2000 | Higuma et al. | 347/86 |
| 6,270,207 | B1 | * | 8/2001 | Sasaki | 347/86 |
| 6,293,663 | B1 | * | 9/2001 | Koshikawa et al. | 347/86 |

FOREIGN PATENT DOCUMENTS

EP 0 711 667 B1 4/1999

* cited by examiner

*Primary Examiner*—Anh T. N. Vo
(74) *Attorney, Agent, or Firm*—David J. Arthur

(57) ABSTRACT

A fluid cartridge for dispensing fluid, such as liquid ink for a drop on demand ink jet printer, includes a housing that encloses a capillary chamber, and has an outlet port through the one wall of the housing into the capillary chamber. Capillary material in the capillary chamber is arranged so that it has a higher density adjacent the outlet port than away from the outlet port, to enhance the flow of the fluid toward the outlet port. The interior of the capillary chamber is structured to provide greater compression to the capillary material around the outlet port, and provide stability to retain the variable compression of the capillary material.

10 Claims, 7 Drawing Sheets

INK CARTRIDGE PROVIDING IMPROVED INK SUPPLY

This application is based on a provisional application No. 60/297,365, filed Jun. 11, 2001.

BACKGROUND

The present invention relates to ink cartridges used for supplying liquid ink to a printhead in a thermal ink jet printing apparatus. Specifically, the present invention relates to structure and method for improving the flow of ink and air through an ink cartridge to provide improved ink delivery to the ink jet printing apparatus.

The principles of thermal ink jet printing are well understood in the art. U.S. Pat. No. 5,997,121 describes several aspects of such printing. In existing thermal ink jet printing, the printhead comprises one or more ink filled channels communicating with a relatively small supply chamber, or manifold, at one end, and having an opening at the opposite end, referred to as a nozzle. Current practical embodiments of drop on demand thermal ink jet printers work most effectively when the pressure of the ink in the printhead nozzle remains within a predetermined range of gauge pressures. Specifically, at those times during operation in which an individual nozzle or an entire printhead is not actively emitting a droplet of ink, a certain negative pressure, or "back pressure", in each of the nozzles, and by extension, within the ink supply manifold of the printhead keeps the ink from dribbling out the nozzles. The attributes of creating and maintaining such back pressure are described in U.S. Pat. No. 5,289,212, the contents of which are hereby incorporated herein by reference.

The liquid ink is supplied to the printhead from an ink cartridge. The ink cartridge contains a supply of ink, and is typically configured to maintain the appropriate negative pressure in the printhead ink channels. The ink cartridge is typically a user replaceable unit that mates with the printhead of the printing apparatus. In certain embodiments, the printhead and the ink cartridge are formed as a single integrated unit. In other embodiments, the ink cartridge or container is manufactured and sold separately from the printhead. The printhead may be permanently installed in the printer, or may be separately replaceable.

SUMMARY

A fluid cartridge for dispensing fluid, such as liquid ink in a drop on demand ink jet printer, includes a housing that encloses a foam chamber, and has an outlet port through one wall of the housing into the foam chamber. Foam material is contained within the foam chamber. The foam material has a higher density adjacent the outlet port than away from the port.

An ink cartridge for dispensing liquid ink to a drop on demand ink jet printer comprises a housing having a top wall, a plurality of sidewalls, and a cover wall, all enclosing an interior space. The top wall and the cover wall oppose one another across the interior space. A divider separates the interior space into a foam chamber and a free ink chamber. A fluid conduit connects the free ink chamber and the foam chamber. Ink-retaining foam material is contained in the foam chamber. An outlet port through the cover wall extends into the foam chamber. First and second structural projections extend from the top wall of the housing into the foam chamber. The first and second structural projections abut the foam material in the foam chamber. The first structural projection is approximately opposite the outlet port through the cover wall, and extends farther into the foam chamber than does the second structural projection.

A method of assembling an ink cartridge for a drop on demand ink jet printer includes supplying a housing having a plurality of walls defining an interior space, and having one side of the housing open to provide access to the interior space. The method further includes compressing ink retaining foam, and inserting the compressed ink retaining foam through the open side of the housing into the interior space of the housing, so that a first portion of the foam in the interior space of the housing is more compressed than a second portion of the foam in the interior space of the housing. A cover wall is applied over the open side of the housing to enclose the foam in the interior space of the housing. In a particular implementation, the cover wall has a port through it, and the step of applying the cover wall over the open side of the housing comprises applying the cover wall so that the port is approximately adjacent the first portion of the foam in the interior space of the housing.

DETAILED DESCRIPTION

Figure 1:
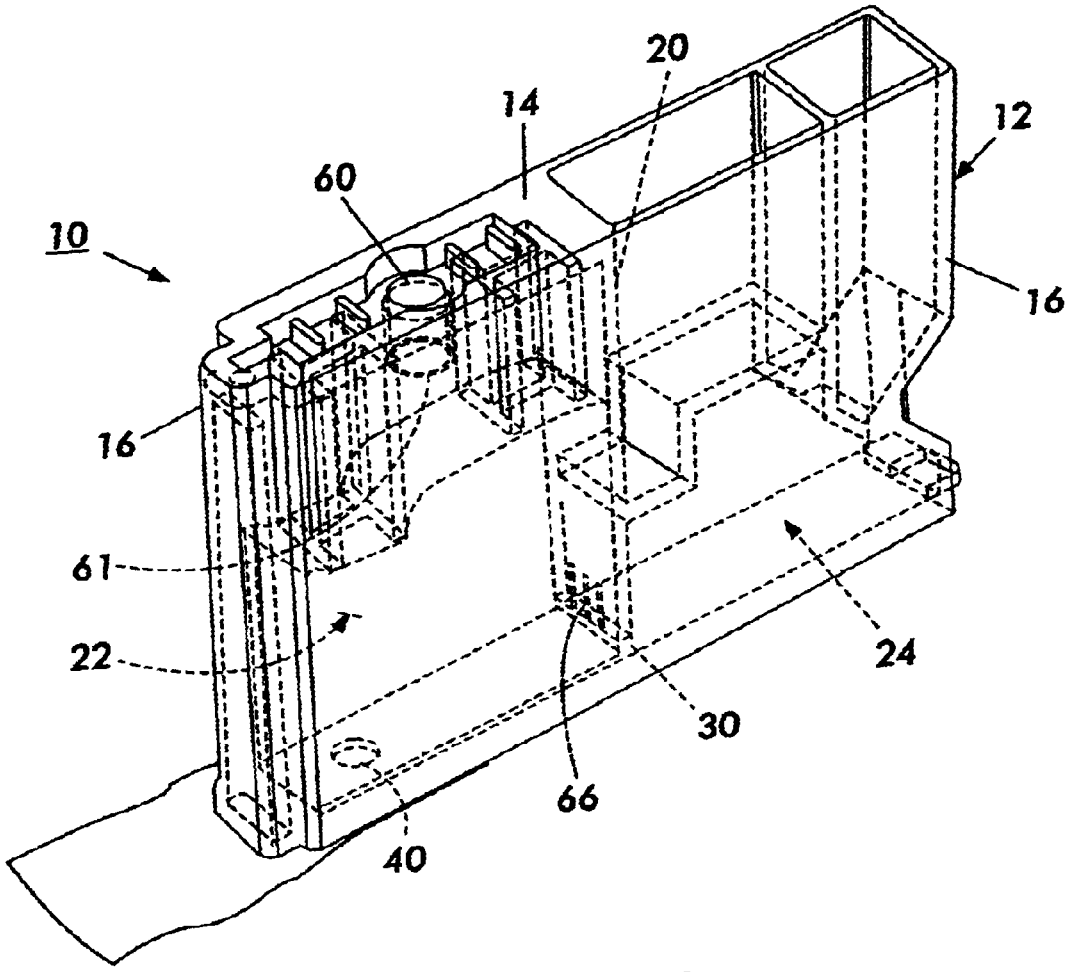
FIG. 1 is a perspective view of an exemplary ink cartridge incorporating a particular embodiment of the present invention, showing the internal structure thereof in phantom.
Figure 2:
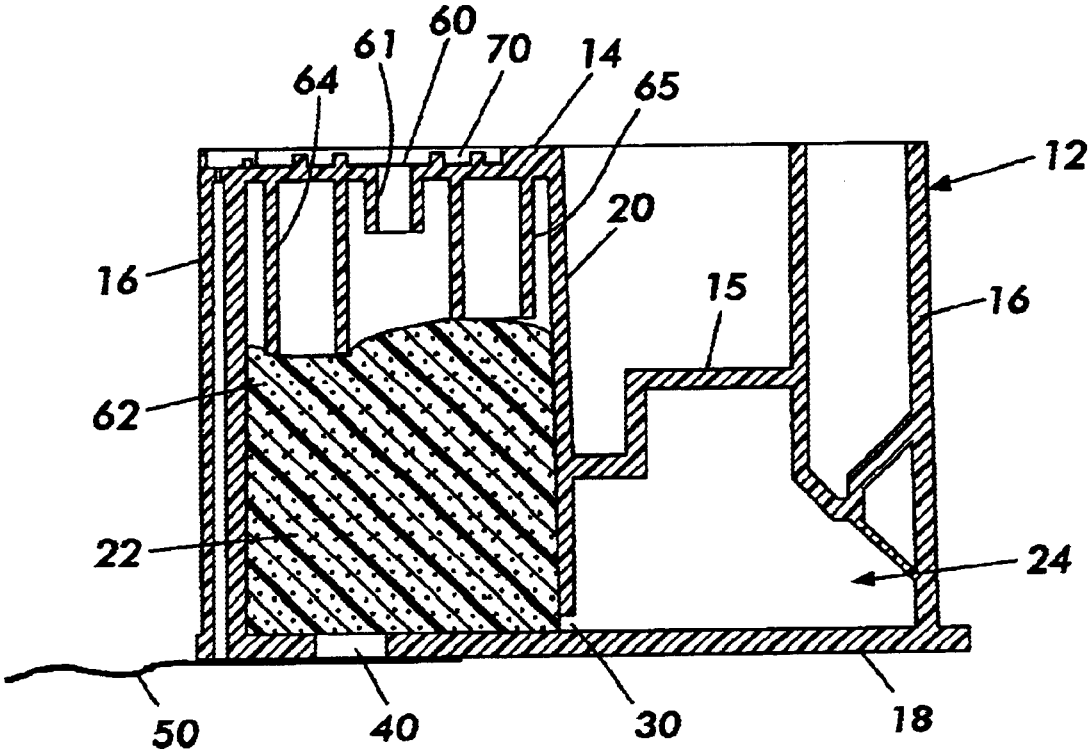
FIG. 2 is a side cross-sectional view of the ink cartridge of FIG. 1.

Referring to FIGS. 1 and 2, a fluid cartridge 10 includes a housing 12 formed of a plurality of walls 14, 15, 16, and a cover wall 18. In the particular embodiment illustrated, the walls of the housing include a top wall 14, 15, and side walls 16 enclosing an interior space. The cover wall 18 encloses the interior space by closing off the open side of the housing body. The cover wall 18 substantially opposes the top wall 14 across the interior space.

The top wall 14 and the side walls 16 of the housing may be a single integral unit of molded plastic. The cover wall 18 may be attached to the housing body by glue, ultrasonic welding, or other appropriate attachment techniques. FIG. 1 shows the internal structure of the cartridge in phantom lines. FIG. 2 is a side cross-sectional view of the ink cartridge of FIG. 1.

The interior of the housing contains a capillary chamber 22 and a free fluid or ink chamber 24. A divider 20 extends from the top wall 14 toward the cover wall 18, and also extends between two opposing side walls 16, to divide the housing interior into the capillary chamber 22 and the ink chamber 24. A fluid conduit 30 provides fluid communication between the ink chamber 24 and the capillary chamber 22. In the embodiment particularly described and shown, the fluid conduit 30 is adjacent the cover wall 18 of the housing, and is formed as a gap in the divider 20 adjacent the cover wall.

An outlet port 40 is formed through one of the walls forming the housing of the capillary chamber. When the ink cartridge is mated with an ink jet printhead, the outlet port 40 provides fluid communication from the ink cartridge capillary chamber 22 to a manifold of the printhead that in turn leads to the channels that form the printhead nozzles. In the particular embodiment illustrated, the outlet port 40 is formed through the cover wall 18. The outlet port 40 is positioned toward the side of the capillary chamber away from the fluid conduit 30 that extends between the free ink chamber 24 and the capillary chamber 22. In certain embodiments, the outlet port may alternatively be formed through one of the side walls 16 of the capillary chamber, generally near the bottom portion of the capillary chamber. The top wall 15 of the ink chamber 24 may be lower than the top wall 14 of the capillary chamber, so that the ink chamber has a smaller volume than the capillary chamber. However, the top wall 15 of the ink chamber may be at the same height as, or in some implementations, higher than the top wall 14 of the capillary chamber 22.

A seal 50 covers the outlet port 40. For example, metallic tape, foil, or other material that ink cannot penetrate is placed on the outer surface of the cover wall 18 to cover the outlet port 40, and is sealed to the outer surface of the cover wall. The seal 50 is removable, so that the user can remove it before inserting the cartridge into the printhead. However, in certain printing devices, the seal may remain in place, and be punctured or otherwise penetrated by the printhead element when the cartridge is installed for use in the printing device.

An ink-retaining member, such as ink-retaining capillary material 62, is contained in the interior of the capillary chamber 22. The capillary material 62 may be a polyether foam material, which material is well understood by those familiar with the art. A particular implementation is described using foam for the capillary material. However, other materials that provide a capillary force can be used without departing from the concepts described. When saturated with liquid (such as ink), the foam material 62 facilitates maintaining a negative pressure in the ink supply manifold and ink jet nozzles of the printhead for proper operation of the printhead. Therefore, the specific material may be different for different print apparatus configurations. The negative pressure is supplied through the action of the pores within the foam that act as tiny capillary tubes. The capillary force supplied by a particular tube within the foam is proportional to the diameter of the tube. Pores per inch is used as a measure of the capillary size of the foam. Thus, as the number of pores per inch increases within the foam, so does the capillary force supplied by the foam.

During printing operations, the printhead draws ink from the ink cartridge through the outlet port 40. As ink is drawn from the foam 62 through the outlet port 40, the capillary force of the foam draws ink from the free ink chamber 24 through the fluid conduit 30 to replenish the ink supply in the foam 62. As ink flows from the free ink chamber 24 into the foam 62 through the fluid conduit 30, air bubbles migrate through the capillary material (foam) 62 to the fluid conduit 30 and into the free ink chamber 24. Thus, the fluid conduit 30 may be referred to as the "bubbler." Air enters the interior of the housing through the vent opening 60 in the top wall of the capillary chamber portion of the housing. The air travels through the foam 62 from the vent opening 60 to the fluid conduit 30. Vertical grooves 66 extend upward along the capillary chamber side of the divider 20 from the fluid conduit opening 30 to assist in the exchange of air and ink through the conduit 30. In addition, incomplete saturation of the foam 62 may cause the foam 62 to contain localized pockets of air that are surrounded by ink.

The cartridge is structured so that the capillary material (foam) 62 has increased density adjacent the outlet port 40 than it does above the fluid conduit opening 30 through the divider 20. For example, the interior of the capillary chamber 22 is structured asymmetrically, so that the space in the capillary chamber for the capillary material above the port 40 is less than the space in the capillary chamber adjacent the divider.

Figure 3:
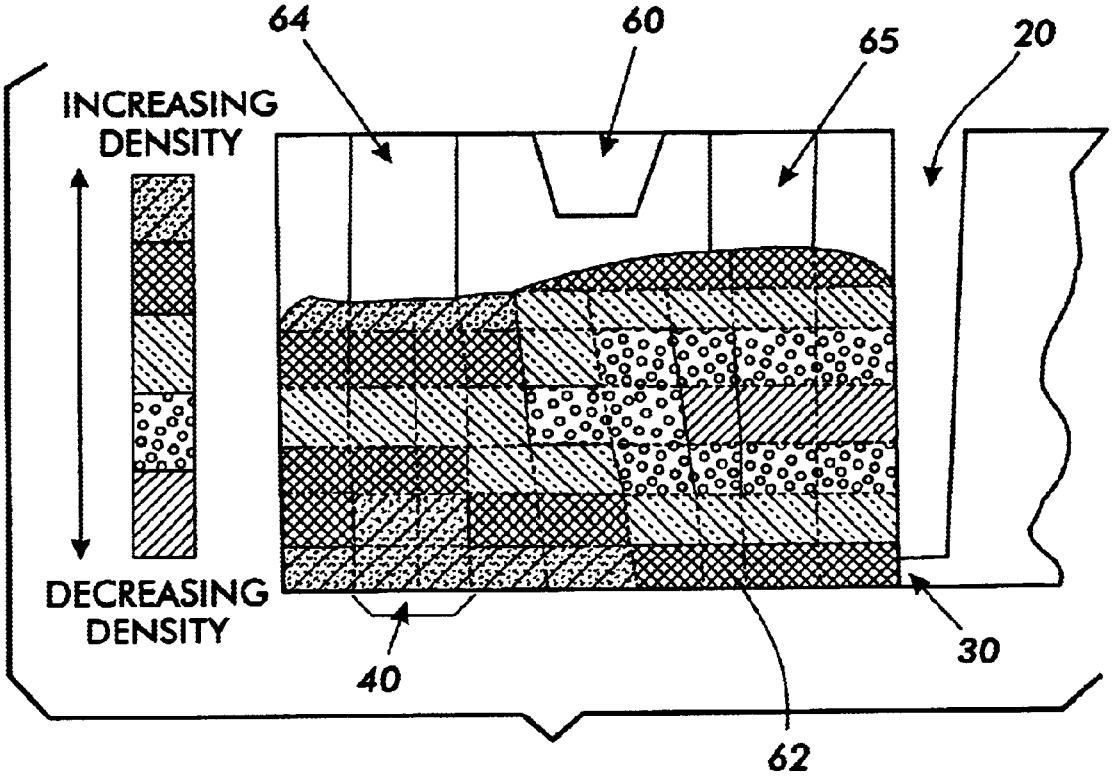
FIG. 3 is a side cross-sectional view of a portion of the ink cartridge shown in FIG. 2, showing different levels of compression of the capillary material in the ink cartridge.

As seen in FIG. 2, projections 64, 65 extend into the interior of the capillary chamber portion 22 of the housing. The projections 64, 65 abut the foam 62 to hold the foam in place in the capillary chamber. The first projection 64 projects farther into the interior of the capillary chamber 22 to provide greater compression to the portion of the foam between the first projection 64 and the cover wall 18, while the second projection 65 provides a lesser amount of compression of the portion of the foam 62 between the second projection 65 and the cover wall 18. The greater density of the foam between the first projection 64 and the cover wall 18 provides a higher number of pores per inch in that portion of the foam. Referring to FIG. 3, the approximate regions of higher and lower density of the foam are illustrated. These areas of higher and lower density are not exact, as the compression of the foam yields a probabilistic distribution of foam density in general accord with the diagram shown in FIG. 3.

The first projection 64, which may be called the port rib, is substantially aligned with the port opening 40, so that the foam between the is port rib and the outlet port is more compressed than the foam away from the outlet port. In particular, the foam above the outlet port 40 is more compressed than the foam near the divider 20. The second projection 65, which may be called the bubbler rib because it is nearer the bubbler conduit 30, projects less far into the interior of the capillary chamber 22 than does the port rib 64. The bubbler rib 65 abuts the upper surface of the foam material 62 to help retain the foam material in place within the capillary chamber, and resist the tendency of the foam material to shift and change its density distribution.

In one particular embodiment, the projections 64, 65 are H shaped in cross-section. However, after reading the present description, those skilled in the art will recognize that numerous other shapes may be used. Among the other possible shapes are referring to their cross-sectional shape Z, I, curved, and other shapes.

The difference in the extent to which the projections 64, 65 extend into the interior of the capillary chamber depends on the size of the capillary chamber, and the desired extent of capillary force differentials. In one particular embodiment, the port rib 64 is approximately 2.0 mm longer than the bubbler rib 65. The interior of the top wall 14 of the capillary chamber may alternatively be shaped in other ways to provide the asymmetrical space for the capillary foam material 62.

Referring to the foam density distribution illustrated in FIG. 3, the increased foam density adjacent the outlet port 40 provides increased foam pores per inch, which in turn yields an increased capillary force near the outlet port 40. In addition to the increased capillary force around the port 40 drawing ink toward the port the relative decreased density adjacent the divider 20 above the bubbler conduit 30 tends to encourage air to follow a path from the vent opening 60 to the fluid bubbler conduit 30, away from the port 40. Increasing the flow of ink toward the outlet opening 40 and reducing the migration of air toward the outlet opening reduces the possibility of "depriming" the manifold and ink channels in the printhead. Depriming occurs when the printhead prematurely ingests air from the outlet port 40 of the ink cartridge into the ink manifold and ink ejection channels.

A region of the foam adjacent and along the cover wall 18 also has a higher density than does the foam away from the cover wall. Increased density foam (with more pores per inch) along the cover wall between the bubbler conduit 30 and the outlet port 40, with its higher capillary force, helps draw ink from the free ink chamber 24 toward the outlet port 40. Such additional draw helps the printer more completely use the ink in the cartridge. This more complete usage of the ink leaves less residual ink in the cartridge when the printer is no longer able to draw ink from the cartridge.

Figure 4:
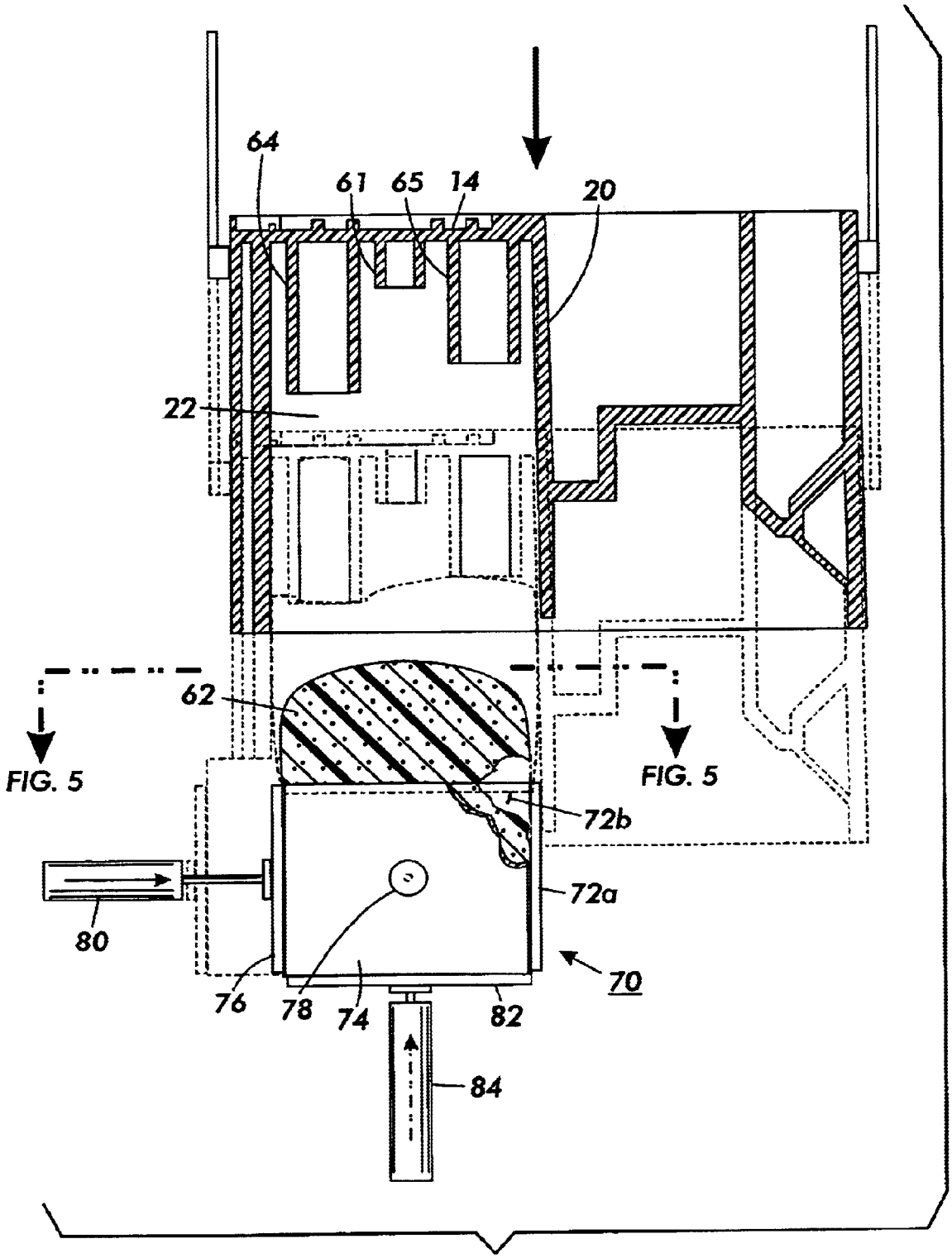
FIG. 4 is a side cross-sectional view of the ink cartridge of FIGS. 1 and 2 before insertion of the capillary material.
Figure 5:
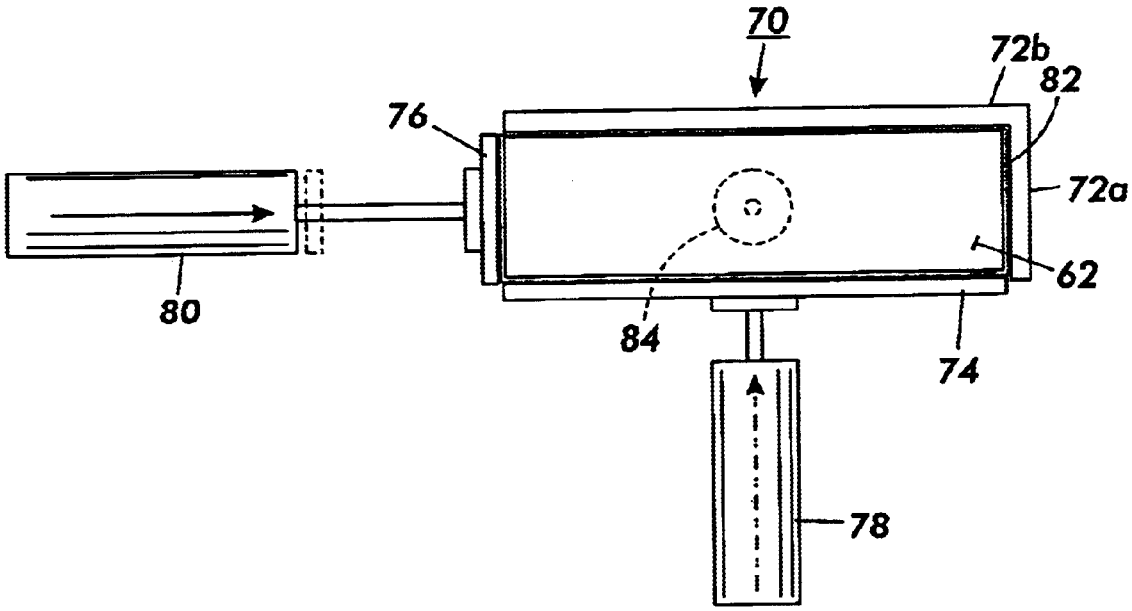
FIG. 5 is an end view of the capillary material and a compression fixture, taken along line 5—5 of FIG. 4.
Figure 6:
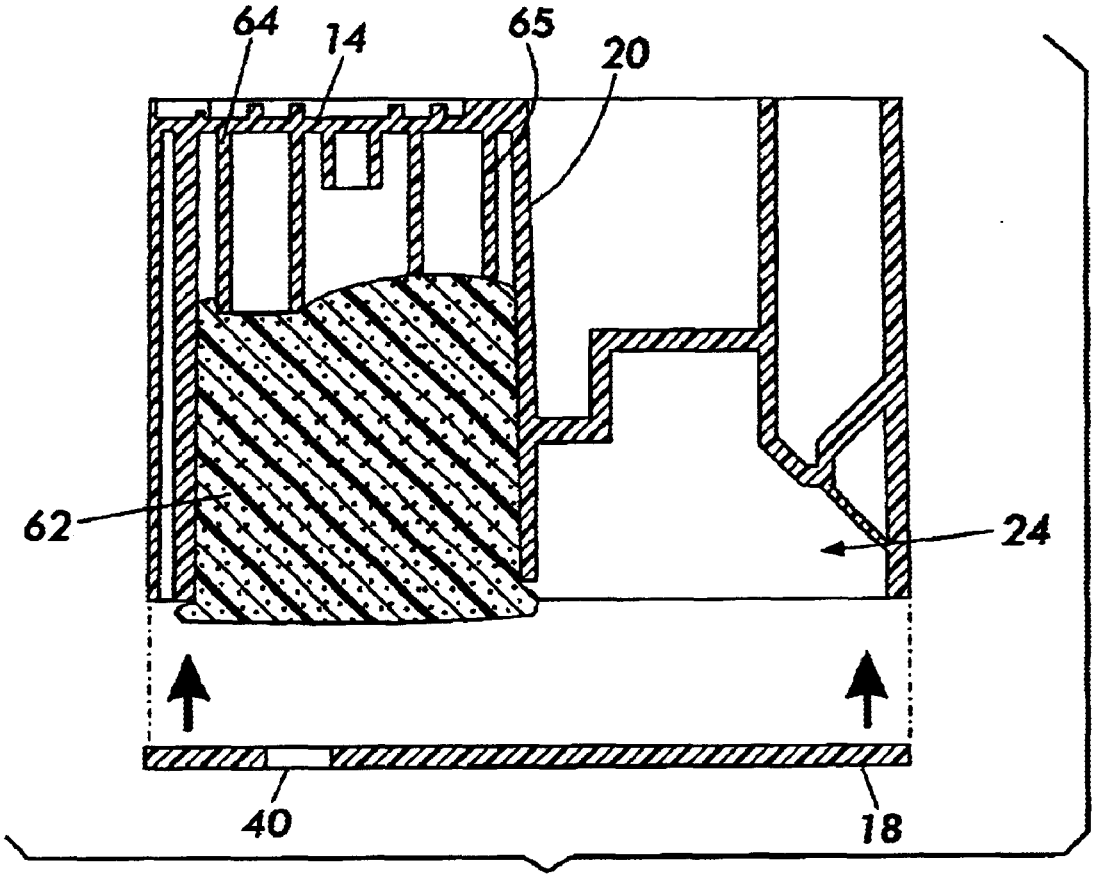
FIG. 6 is a cross-sectional view of the ink jet cartridge shown in FIG. 4 showing the cartridge partially assembled.

FIG. 4 shows the foam compressed and prepared for insertion into the capillary chamber 22 of the ink cartridge. The foam, in an uncompressed state, is considerably larger than the interior of the capillary chamber 22. The foam 62 is initially a rectangular block of the foam material. To insert the foam material into the capillary chamber 22, the foam is compressed by a compression fixture 70 to a size smaller than the interior of the capillary chamber 22. Referring now to FIG. 5, the compression fixture includes a corner element 72 and two side fingers 74, 76. For the compression fixture to compress the foam for insertion into the capillary chamber, the foam material is placed near or against the corner element 72, as seen in the view of FIG. 5, which is from above the foam. The side of the foam that is to be adjacent the divider 20 of the cartridge housing (see FIG. 2) is placed against one leg 72*a* of the corner element. The first finger 74 presses against the side of the foam to compress the foam material laterally between the first finger 74 and the leg 72*b* of the corner element. After the first finger 74 has laterally compressed the foam material, a second finger 76 presses against the foam, compressing the foam longitudinally against the first leg of the corner element 72. Friction between the surface of the foam and the elements 72, 74 of the compression fixture cause the foam to be more compressed nearer the second finger 76 than near the first leg 72*a* of the corner element. Different mechanisms can be used to move the fingers 74, 76 to compress the foam, such as a screw drive, hydraulic drive, or pneumatic drive. For example, an air cylinder may drive the shaft of each finger.

The compression fixture inserts the compressed foam at least partway into the capillary chamber of the housing. For example, the compression fixture may insert the compressed foam (and the corner element 72 and the fingers 74, 76 of the compression fixture) about half-way into the capillary chamber. The air cylinders holding the fingers 74, 76 against the foam are released. The foam slightly expands, although the fingers do not completely release the foam, as the fingers are constrained within the interior of the capillary chamber. A plunger 78 then presses the foam the remainder of the way into the capillary chamber. The compression fixture withdraws the fingers 74, 76 from the interior of the capillary chamber while the plunger 78 holds the foam material in place in the capillary chamber.

The compression fixture then removes the plunger 78, and the cover wall 18 is placed over the open side of the capillary chamber 22 (and the free ink chamber 24). In a particular implementation, to obtain increased foam density adjacent the cover wall, when the foam 62 is inserted into the capillary chamber 22, a small portion (1.5–3.0 mm) of the foam material remains extending beyond the open end of the capillary chamber 22. Then, when the cover wall 18 is applied over the open side of the housing, to enclose the interior space of the housing, the cover wall 18 completes the compression of the foam material adjacent the open side of the housing. Thus, after the cover wall is sealed to the housing body, the foam material adjacent the cover wall 18 has a higher density than does foam material away from the cover wall 18 and aligned with the bubbler rib 65. As the cover is brought into place, it also further compresses the foam material between the cover wall 18 and the port rib 64, so that the foam material in that region has a higher density than does the foam material between the cover wall 18 and the bubbler rib 65.

Figure 7:
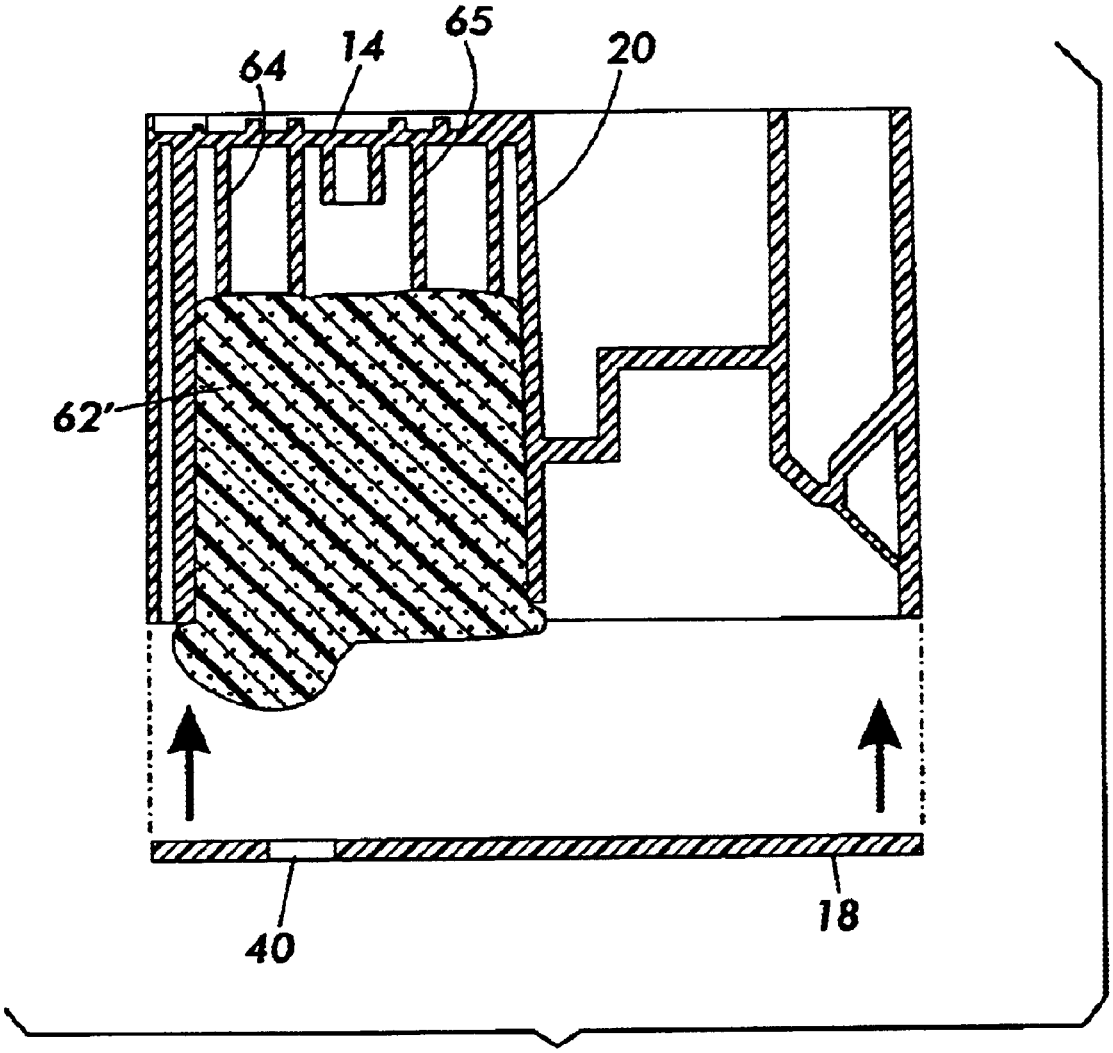
FIG. 7 is a cross-sectional view of an alternative embodiment of an ink cartridge incorporating an aspect of the present invention.

Referring now to FIG. 7, an implementation is illustrated in which the top of the capillary chamber is symmetrical, in that the port rib 64 and the bubbler rib 65 are of equal length. The capillary material or foam 62' is formed asymmetrically, with a greater amount of capillary material aligned with the port rib 64 than is aligned with the bubbler rib 65. When the capillary material 62' is compressed into the capillary chamber 22, and the cover wall 18 is placed over the open end of the capillary chamber, the capillary material 62' between the port rib 64 and the cover wall 18 is more compressed than is the capillary material between the bubbler rib 65 and the cover wall.

Those skilled in the art will recognize that various modifications can be made to the particular implementations described above and shown in the accompanying figures. For example, numerous modifications can be made to the shape of the ribs, as well as the interior shapes of the capillary chamber and the free ink chamber. In addition, other mechanisms can be employed in the housing to provide variable compression to the foam material in the capillary chamber, such as providing projections along the sides of the chamber, or differently shaped ribs, or other shapes to the capillary or foam material. Other types of materials may be used to provide the appropriate capillary forces to draw fluid. Furthermore, the outlet port and vent openings can be provided in different locations than the specific embodiment illustrated. In addition, although particular implementations have been described in connection with thermal ink jet printers, the principles can also be applied to implementations in connection with other types of ink printers, and in particular, with other types of liquid ink printers. Therefore, the present invention is not to be limited to the specific implementation described above.

We claim:

1. A fluid cartridge for dispensing fluid, the cartridge comprising:

a housing comprising a plurality of walls enclosing a capillary chamber, and having a port through one wall of the housing into the capillary chamber; and capillary material contained within the capillary chambers, wherein the housing shape provides variable compression to the capillary material so that the capillary material has a higher density adjacent the port than away from the port;

wherein the housing additionally encloses a free fluid chamber;

wherein the fluid cartridge additionally comprises a fluid conduit between the free fluid chamber and the capillary chamber; and wherein the capillary material has a higher density along a fluid path between the fluid conduit and the port than above the fluid conduit.

2. The fluid cartridge of claim 1, wherein:

the fluid cartridge additionally comprises a cover wall forming a portion of the housing enclosing the capillary chamber;

the port is through the cover wall of the housing; and the capillary material has a higher density adjacent the cover wall than away from the cover wall.

3. The fluid cartridge of claim 2, wherein the fluid conduit is adjacent the cover wall of the housing.

4. The fluid cartridge of claim 3, wherein the capillary material adjacent the cover wall and between the fluid conduit and the port is compressed to a higher density than the capillary material away from the cover wall, to form the fluid path between the fluid conduit and the port.

5. The fluid cartridge of claim 4, wherein the interior end of the port is substantially flush with the interior surface of the cover wall.

6. The fluid cartridge of claim 2, additionally comprising a projection from the wall opposite the cover wall into the capillary chamber, wherein the projection compresses the capillary material.

7. The fluid cartridge of claim 2, additionally comprising a projection from the wall opposite the cover wall into the capillary chamber, wherein the projection is approximately opposite the port, and the projection compresses the capillary material between the projection and the port to a higher degree of compression than other portions of the capillary material.

8. The fluid cartridge of claim 7, additionally comprising a second projection from the wall opposite the cover wall into the capillary chamber, wherein the second projection extends less far into the capillary chamber than does the first projection.

9. The fluid cartridge of claim 1, wherein the housing shape compresses the capillary material adjacent the port to a higher density than the capillary material along the path between the fluid conduit and the port.

10. An ink cartridge for dispensing liquid ink to a drop on demand ink jet printer the ink cartridge comprising:

a housing having a top wall, a plurality of side walls, and a cover wall enclosing an interior space, wherein the top wall and the cover wall oppose one another across the interior space and wherein the interior surface of the cover wall is substantially planar;

a divider separating the interior space into a capillary chamber and a free ink chamber;

a fluid conduit between the free ink chamber and the capillary chamber, the fluid conduit comprising an opening through the divider;

ink-retaining material in the capillary chamber;

an outlet port through the cover wall into the capillary chamber, wherein the interior opening of the outlet port is substantially flush with the interior surface of the cover wall; and first and second structural projections from the top wall of the housing into the capillary chamber;

wherein:

the first and second structural projections abut the ink-retaining material;

the first structural projection is a approximately opposite the outlet port;

the first structural projection extends farther into the capillary chamber than does the second structural projection;

the second structural projection is closer to the divider than is the first structural projection;

the opening through the divider is adjacent the cover wall; and the density of the ink-retaining material along the interior surface of the cover wall between the opening and the outlet port is higher than the density of the ink-retaining material adjacent the divider and away from the cover wall.

* * * * *